US005538246A

United States Patent [19]

Dekura

[11] Patent Number: 5,538,246

[45] Date of Patent: Jul. 23, 1996

[54] GOLF CLUB

[75] Inventor: Shoichi Dekura, Tokyo, Japan

[73] Assignee: Daiwa Seiko, Inc., Tokyo, Japan

[21] Appl. No.: 423,145

[22] Filed: Apr. 17, 1995

[30] Foreign Application Priority Data

Aug. 4, 1994 [JP] Japan ..... 6-183171

[51] Int. Cl.[6] ..... A63B 53/02; A63B 53/10

[52] U.S. Cl. ..... 473/331; 273/DIG. 23; 473/305; 473/319; 473/346; 473/349

[58] Field of Search ..... 273/167 R, 167 A, 273/167 H, 169, 167 F, 80.1, 80.2, 80.3, 80.4, 80.5, 80.6, 80.7, 80.8, 80 B, 167 K, DIG. 23

[56] References Cited

U.S. PATENT DOCUMENTS

| | | | |
|---|---|---|---|
| 1,601,770 | 10/1926 | Reach | 273/80.4 |
| 2,880,002 | 3/1959 | Wetty | 273/80.5 |
| 3,572,709 | 3/1971 | Risher | 273/80.2 |
| 3,873,090 | 3/1975 | Thompson | 273/80.8 |
| 4,449,707 | 5/1984 | Hayashi | 273/167 H |
| 4,516,778 | 5/1985 | Cleveland | 273/167 H |
| 4,757,997 | 7/1988 | Roy | 273/80 B |
| 5,273,280 | 12/1993 | Lo | 273/80.3 |

*Primary Examiner*—Sebastiano Passaniti
*Attorney, Agent, or Firm*—Longacre & White

[57] ABSTRACT

The invention relates to a golf club by which a soft ball hitting feeling can be obtained while the excellent orientation of a ball peculiar to a hollow metallic head is maintained. A shaft is inserted into a hosel attaching section of a hollow metallic head through a hosel. The head is made of magnesium alloy or aluminum alloy, and the shaft is made of carbon fiber reinforced resin. The hosel is made of synthetic resin, the rigidity of which is lower than that of the shaft.

10 Claims, 3 Drawing Sheets

GOLF CLUB

BACKGROUND OF THE INVENTION

The present invention relates to a golf club to which a hollow metallic head is attached.

From the viewpoints of stabilizing the quality and making it easy to procure the material, a golf club referred to as "wood" employs a hollow metallic head made of stainless steel widely in these days instead of a wooden head made from natural wood such as persimmon or cherry. Since the strength of metal is higher than the strength of wood, it is possible to form a head, the thickness of which is reduced so that the weight is distributed to a periphery of the head. In this way, the moment of inertia of the head is increased, and the orientation of a ball hit by the head can be stabilized.

However, the ball hitting feeling of a metallic head is harder than that of a golf club provided with a head made of natural wood. Further, as shown in FIG. 3, the conventional metallic head 1 is composed in such a manner that the metallic hosel 5 is formed integrally with the metallic head body 3, and shaft 7 is inserted into the hosel 5. Therefore, the conventional metallic head 1 is disadvantageous in that a soft ball hitting feeling can not be obtained.

In view of the actual circumstances described above, recently, a shaft made of carbon fiber reinforced resin is attached to a metallic head so as to reduce the vibration given to the head when a ball is hit. Further, the golf club 17 illustrated in FIG. 4 is proposed, the structure of which is described as follows: The head 9 is made of stainless steel. From the top 9*a* of the head 9 to the sole 9*b*, the hosel attaching section 11 diagonally penetrating through the head 9 is integrally formed. The shaft 15 is inserted into the hosel attaching section 11 through the hosel 13 made of fiber reinforced plastics such as carbon reinforced fiber or glass reinforced fiber.

However, a sufficiently soft ball hitting feeling can not be obtained even by the golf club in which the shaft made of carbon fiber reinforced resin is attached to the metallic head. Even in the case of the golf club 17 shown in FIG. 4 wherein the shaft 15 is inserted into the head 9 through the hosel 13 made of fiber reinforced plastics, a sufficiently soft ball hitting feeling can not be still obtained since hard vibration generated when a ball is hit with the head 9 made of stainless steel having a high specific gravity (7.8) is transmitted from the entire hosel attaching section to the shaft 15.

SUMMARY OF THE INVENTION

In view of the above circumstances, the present invention has been achieved. It is an object of the present invention to provide a golf club by which a ball can be hit with a soft feeling while the excellent orientation peculiar to a hollow metallic head is maintained.

In order to accomplish the above object, the invention provides a golf club in which a shaft is inserted into a hosel attaching section of a hollow metallic head through a hosel, wherein: the head is made of light metal such as magnesium alloy or aluminum alloy; the shaft is made of carbon fiber reinforced resin; and the hosel is made of synthetic resin.

When a ball is hit with the golf club according to the invention, the ball flies with an excellent orientation since the head weight is distributed to the periphery in the same manner as the conventional hollow metallic head so that a high moment of inertia can be provided.

At this time, vibration end shock are generated in the head by the ball. However, the head is made of light metal, the specific gravity of which is lower than that of stainless steel. Therefore, vibration and shock generated by the ball is far lower than that of a conventional hollow metallic head made of stainless steel.

In case the hosel made of synthetic resin, the rigidity of which is lower than that of the shaft absorbs the generated vibration and shock, the vibration transmitted to the shaft is remarkably reduced.

DETAILED DESCRIPTION OF THE PREFERRED EMBODIMENTS

With reference to the accompanying drawings, preferred embodiments of the present invention will be explained as follows.

Figure 1:
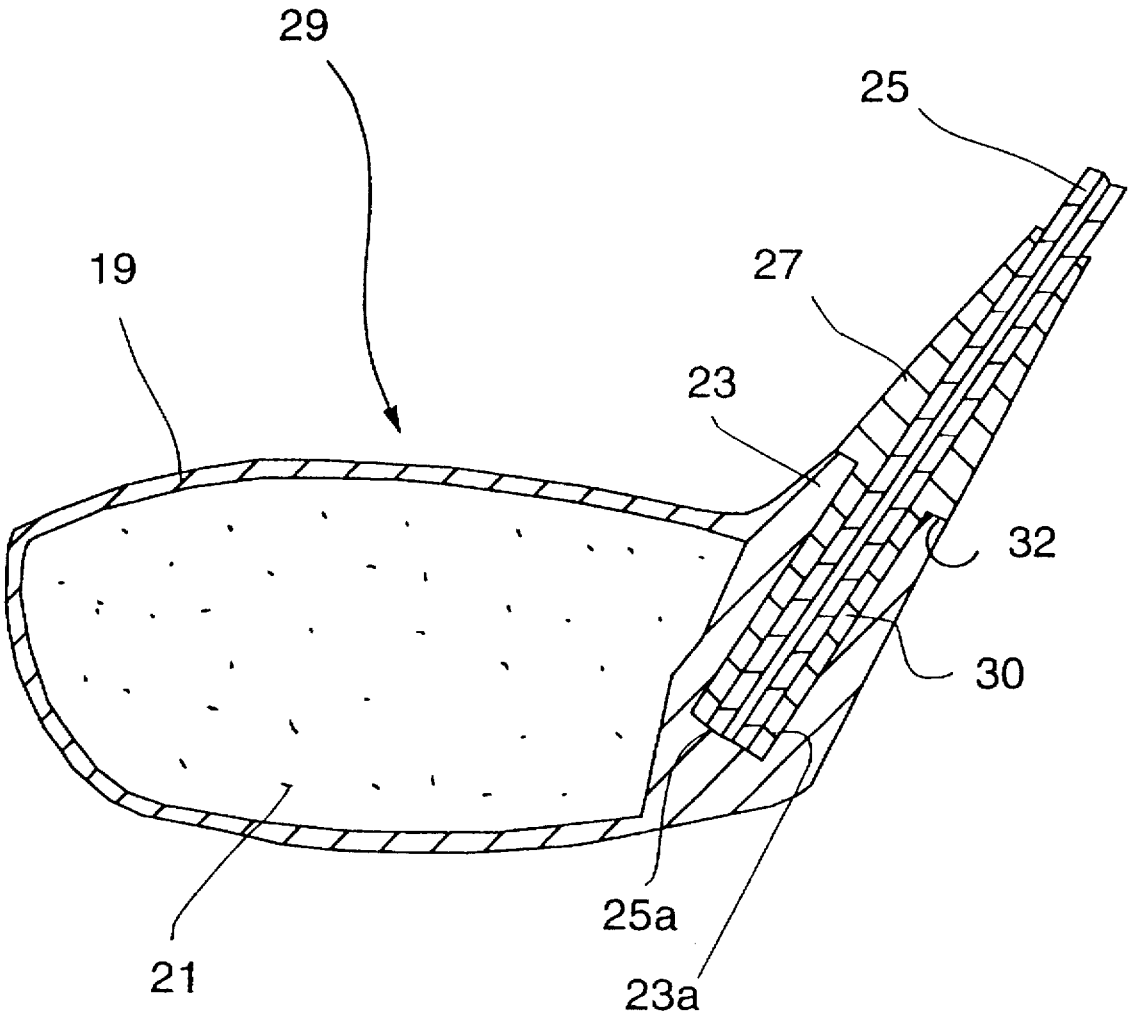
FIG. 1 is a sectional view showing a primary portion of a golf club according to an embodiment of the present invention.

FIG. 1 is a view showing a golf club according to an embodiment of the present invention. In FIG. 1, numeral 19 is a hollow head made of light metal such as magnesium alloy (specific gravity: 1.8) or aluminum alloy (specific gravity: 2.8), the specific gravity of which is lower than that of stainless steel (specific gravity: 7.8). In the same manner as the conventional hollow metal head, in order to increase the moment of inertia, the thickness of the head is reduced, and the inside of the head is filled with a filling member 21 such as foaming synthetic resin.

The hosel attaching section 23 diagonally protruding upward is provided on the heel side of the head 19. The hosel attaching hole 23*a* is formed in the hosel attaching section 23 in a direction of the insertion of the shaft 25.

In the drawing, numeral 27 is a hosel inserted into the hosel insertion hole 23*a*. The hosel 27 is formed with an insertion portion 30 inserted into the hosel insertion hole 23*a* and an abutment portion 32 brought into abutment with an end face of the hosel attaching section 23. The abutment portion 32 abutment with the end face of the hosel attaching section 23 prevents an excessive and abrupt deformation of the shaft 25 at this portion due to the stress concentration when a ball is hit.

The shaft 25 made of carbon fiber reinforced resin is attached to the head 19 through the hosel 27. The hosel 27 is formed into a cylindrical shape from synthetic resin such as ABS and epoxy, the carbon content of which is lower than that of the shaft 25. The hosel may be formed of synthetic resin containing no carbon therein. The hosel 27 absorbs the vibration generated when the club hits a ball, so that the hosel functions as a cushioning member for reducing the vibration transmitted from the head 19 to the shaft 25.

In this connection, the hosel 27 may be previously attached to the shaft 25 on the insertion end side 25*a*, and then inserted into the hosel insertion hole 23*a* together with the shaft 25. Alternatively, the hosel 27 may be attached to the head 19 separately from the shaft 25, and then the shaft 25 may be inserted into the hosel 27. In this embodiment, the end 25*a* on the insertion side of the shaft 25 comes into contact with a bottom of the hosel insertion hole 23*a*, and thus the shaft 25 is contacted with the head 19.

When a ball is hit with the golf club 29 of this embodiment constructed as described above, the ball flies with an excellent orientation since the weight of the head 19 is distributed to the periphery and moment of inertia is highly increased in the same manner as the conventional example.

At this time, vibration and impact are generated in the head 19 by the ball. However, as described above, the head 19 is made of magnesium alloy or aluminum alloy, the specific gravity of which is lower than the specific gravity of stainless steel. Therefore, the generated vibration and impact are far lower than the vibration and impact generated in the conventional hollow metallic head made of stainless steel. The generated vibration and impact are absorbed by the hosel 27, the rigidity of which is lower than the rigidity of the shaft 25, so that the vibration transmitted to the shaft 25 is remarkably reduced. Accordingly, as compared with the example shown in FIG. 4, an amount of vibration transmitted from the head 19 to the shaft 25 is remarkably reduced.

Figure 4:
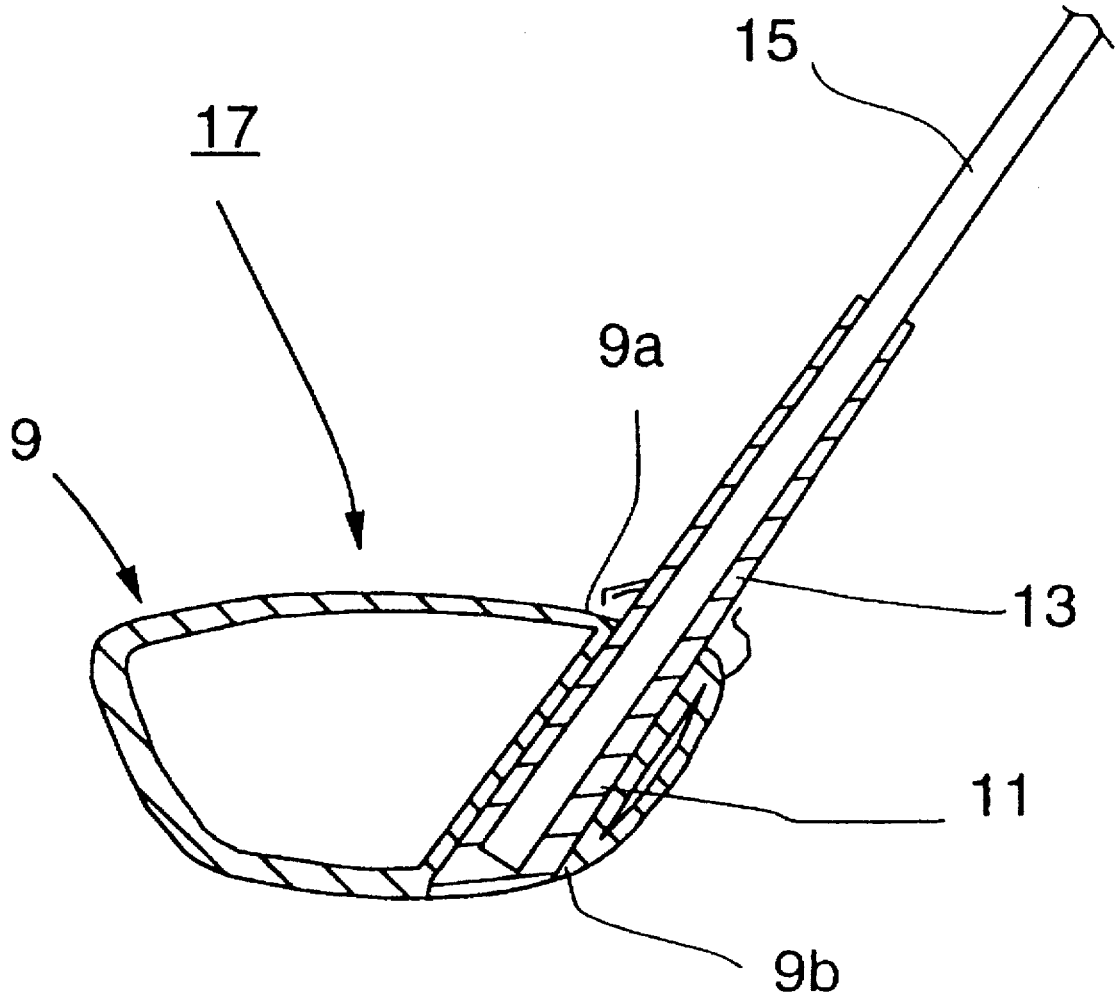
FIG. 4 is a sectional view showing a primary portion of a golf club to which another conventional metallic head is attached.

As described above, according to the golf club 29 of this embodiment, the vibration of the head 10 generated when a ball is hit is lower than the vibration of the golf club 17 shown in FIG. 4. Further, the transmittal of the generated vibration from the head 19 to the shaft 25 is absorbed and reduced by the hosel 27. Accordingly, a ball hitting feeling softer than that of a conventional golf club can be provided while the excellent orientation of a ball peculiar to a hollow metallic head is maintained.

Figure 2:
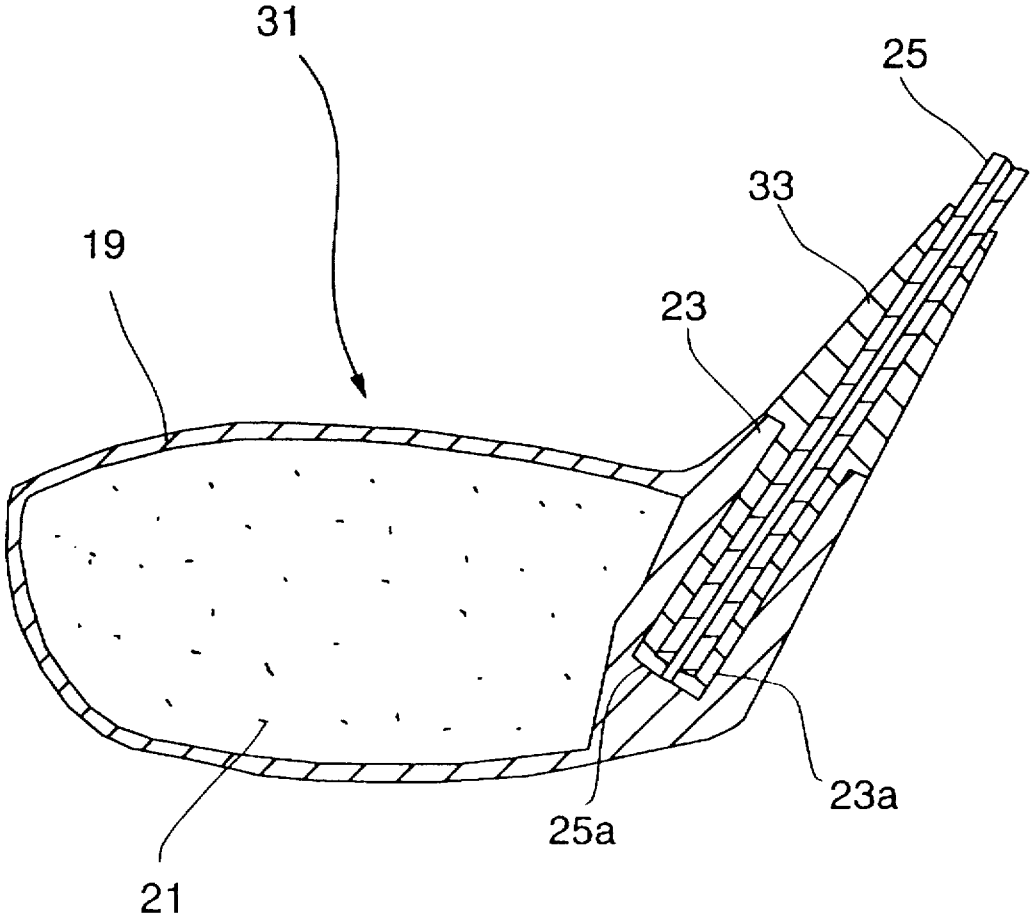
FIG. 2 is a sectional view showing a primary portion of a golf club according to another embodiment of the present invention.
Figure 3:
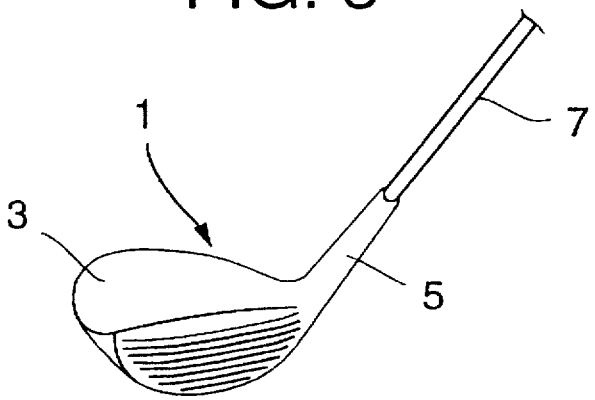
FIG. 3 is a perspective view of a golf club to which a conventional metallic head is attached.

FIG. 2 shows a golf club according to another embodiment of the invention. In the aforementioned embodiment, an end 25*a* of the shaft 25 on the insertion side is contacted with a bottom of the hosel insertion hole 23*a*, so that the shaft 25 comes into contact with the head 19. However, in the case of the golf club 31 of this embodiment, the hosel 33 is made of the same material as that of the hosel 27, into a cylindrical shape having a bottom portion. Therefore, the end portion 25*a* of the shaft 25 on the insertion side is not contacted with the head 19.

Since other points of structure of this embodiment are the same as those of the first embodiment described above, like reference characters are used to indicate like parts in various views, and the explanations are omitted here.

In this embodiment, the following advantages are provided. Of course, the excellent orientation of a ball peculiar to the hollow metallic head is also maintained. Since the shaft 25 and the head 19 are not contacted with each other, the transmission of vibration from the head 19 to the shaft 25 can be more positively prevented, and a softer ball hitting feeling can be obtained.

As described above, according to the golf club of the present invention, the vibration of a head generated at the time of hitting a ball is lower than the vibration generated in the club to which the conventional hollow metallic head is attached, and further the vibration transmitted from the head to the shaft is absorbed and reduced by the hosel. Consequently, it is possible to obtain a ball hitting feeling softer than that of the conventional club while the excellent orientation peculiar to the hollow metallic head is maintained.

In case where the golf club is arranged so that the shaft is not contacted with the head, it is possible to more positively prevent the vibration from being transmitted from the head to the shaft. Consequently, a softer ball hitting feeling can be obtained.

What is claimed is:

1. A golf club comprising a shaft, a hosel and a hollow metallic club head having a hosel attaching section wherein said shaft is inserted into said hosel attaching section of said head through said hosel, wherein: said head is made of light metal, said shaft is made of carbon fiber reinforced resin; and said hosel is made of synthetic resin.

2. A golf club according to claim 1, wherein said hosel is made of a material, the rigidity of which is lower than the rigidity of said shaft.

3. A golf club according to claim 1, wherein said hosel is made of material, the carbon content of which is lower than the carbon content of said shaft.

4. A golf club according to claim 1, wherein said shaft is in non-contact with said head.

5. A golf club according to claim 1, wherein said shaft has an end inserted into and embedded within said head, and said hosel has an end inserted into and embedded within said head.

6. A golf club according to claim 1, wherein said shaft, said hosel and an inner peripheral surface of said hosel attaching section are concentric to each other.

7. A golf club according to claim 1, wherein said light metal includes one of magnesium alloy and aluminum alloy.

8. A golf club according to claim 5, wherein said club head comprises a sole, and said end of said hosel is located in the vicinity of said sole of said head.

9. A golf club according to claim 1, wherein both said shaft and said hosel have an end inserted into said head, each of said respective ends defining an end surface which are flush with each other.

10. A golf club according to claim 1, wherein said hosel includes an insertion portion inserted into said hosel attaching section, and an abutment portion brought into abutment with an end face of said hosel attaching section.

* * * * *